US011335193B1

(12) United States Patent
Scandiffio

(10) Patent No.: US 11,335,193 B1
(45) Date of Patent: May 17, 2022

(54) BICYCLE SAFELY STREET WARNING

(71) Applicant: Carlos Alberto Scandiffio, Miami Beach, FL (US)

(72) Inventor: Carlos Alberto Scandiffio, Miami Beach, FL (US)

( * ) Notice: Subject to any disclaimer, the term of this patent is extended or adjusted under 35 U.S.C. 154(b) by 0 days.

(21) Appl. No.: 16/664,798

(22) Filed: Oct. 26, 2019

(51) Int. Cl.

| | |
|---|---|
| ***G08G 1/005*** | (2006.01) |
| ***G08G 1/0962*** | (2006.01) |
| ***G08G 99/00*** | (2006.01) |
| *G08G 1/095* | (2006.01) |

(52) U.S. Cl.
CPC ..... *G08G 1/0962* (2013.01); *G08G 1/005* (2013.01); *G08G 99/00* (2013.01); *G08G 1/095* (2013.01)

(58) Field of Classification Search
CPC ..... G08G 1/005; G08G 99/00; G08G 1/095
See application file for complete search history.

(56) References Cited

U.S. PATENT DOCUMENTS

| | | | | |
|---|---|---|---|---|
| 10,304,341 | B1 * | 5/2019 | Crasso | H04W 4/46 |
| 2003/0191577 | A1 * | 10/2003 | Decaux | G08G 1/164 701/117 |
| 2005/0134440 | A1 * | 6/2005 | Breed | G01S 17/931 701/45 |
| 2007/0188312 | A1 * | 8/2007 | Bihler | B60Q 9/008 701/49 |
| 2019/0073695 | A1 * | 3/2019 | Wasserman | G08G 1/04 |

FOREIGN PATENT DOCUMENTS

| | | | | |
|---|---|---|---|---|
| DE | 102009038570 B3 * | 2/2011 | | G08B 5/38 |

* cited by examiner

*Primary Examiner* — Qutbuddin Ghulamali
(74) *Attorney, Agent, or Firm* — Rouget F. Henschel; Potomac Law Group, PLLC

(57) ABSTRACT

A traffic safety triggering device that helps motorists and pedestrian become aware of the presence of one or more cyclists on the road. This portable device triggers a safety warning signal that flashes intermittently for a few seconds, thereby making motorists and pedestrians in the immediate area aware of the presence of cyclists, identifying their direction of travel and volume thereof.

2 Claims, 2 Drawing Sheets

BICYCLE SAFELY STREET WARNING

FIELD OF THE DISCLOSURE

Disclosed embodiments relate to warning devices and systems, and more specifically, to such devices and systems enabling delivery of an alert as to the presence of cyclists which may be visualized by cyclists and others in a vicinity of the alert.

BACKGROUND

Safety is of utmost importance when traveling on roadways, trails, and other routes traversed by motorists, cyclists, and pedestrians. Often, there exists a lack of warning as to the presence of, namely, cyclists on such routes. Such lack of warning is an inherent danger to not only the cyclists but also to those individuals who may need to exercise caution to promote a safe operating environment when in the presence of such cyclists.

Accordingly, it would be desirable to provide a warning system enabling the delivery of an alert advising of the presence of cyclists in order to optimize safety among those individuals that may be impacted by such presence.

SUMMARY

It is to be understood that both the following summary and the detailed description are exemplary and explanatory and are intended to provide further explanation of the present embodiments as claimed. Neither the summary nor the description that follows is intended to define or limit the scope of the present embodiments to the particular features mentioned in the summary or in the description. Rather, the scope of the present embodiments is defined by the appended claims.

This device was created as a means to protect both motorists as well as cyclists, by way of alerting traffic about the presence of cyclists nearby. The device consists of a transmitter mounted on the bicycle that sends a signal to a box installed on a sidewalk pole as the cyclist approaches the pole. The signal is received by the box and immediately routed to a small, rectangular screen that begins to flash a warning message intermittently for a period of 15 to 20 seconds. The lights in the screen are sufficiently bright to call the attention of motorists, thereby allowing them to become aware of traffic and cyclists in particular. Boxes and their corresponding screens can be installed at busy intersections, or any specific places where statistics have demonstrated a considerable incidence of accidents involving motorists and cyclists.

BRIEF DESCRIPTION OF THE DRAWINGS

The accompanying drawings, which are incorporated herein and form a part of the specification, illustrate exemplary embodiments and, together with the description, further serve to enable a person skilled in the pertinent art to make and use these embodiments and others that will be apparent to those skilled in the art. Embodiments herein will be more particularly described in conjunction with the following drawings wherein.

DETAILED DESCRIPTION

The Bicycle Safety Street Warning (hereinafter referred to as the "BSSW") device is actually a combination of transmitter, receiver and LED projector that serves to forewarn motorists of bicycle traffic in their immediate area. To achieve this, the cyclist adds an additional sensor (transmitter) to the bicycle that will act as the transmitter of a wireless signal. The sensor is capable of transmitting a signal between 40 and 45 feet from the target. The signal is transmitted to a receiver placed in a small box mounted on an existing or new street pole. The box in turn triggers a transmission of a pre-programmed message to a small, non-intrusive LED screen. The LED screen flashes the message "CYCLISTS PRESENT" intermittently so as to call the attention of the motorists, similar to the warning lights that are used today for pedestrians. The bright LED screen needs to be, at a minimum, 24" long×6" wide in order to send sufficient visual impact to the immediate traffic, albeit the recommended size is 48"×14," in order to cover a greater visual angle.

Figure 1:
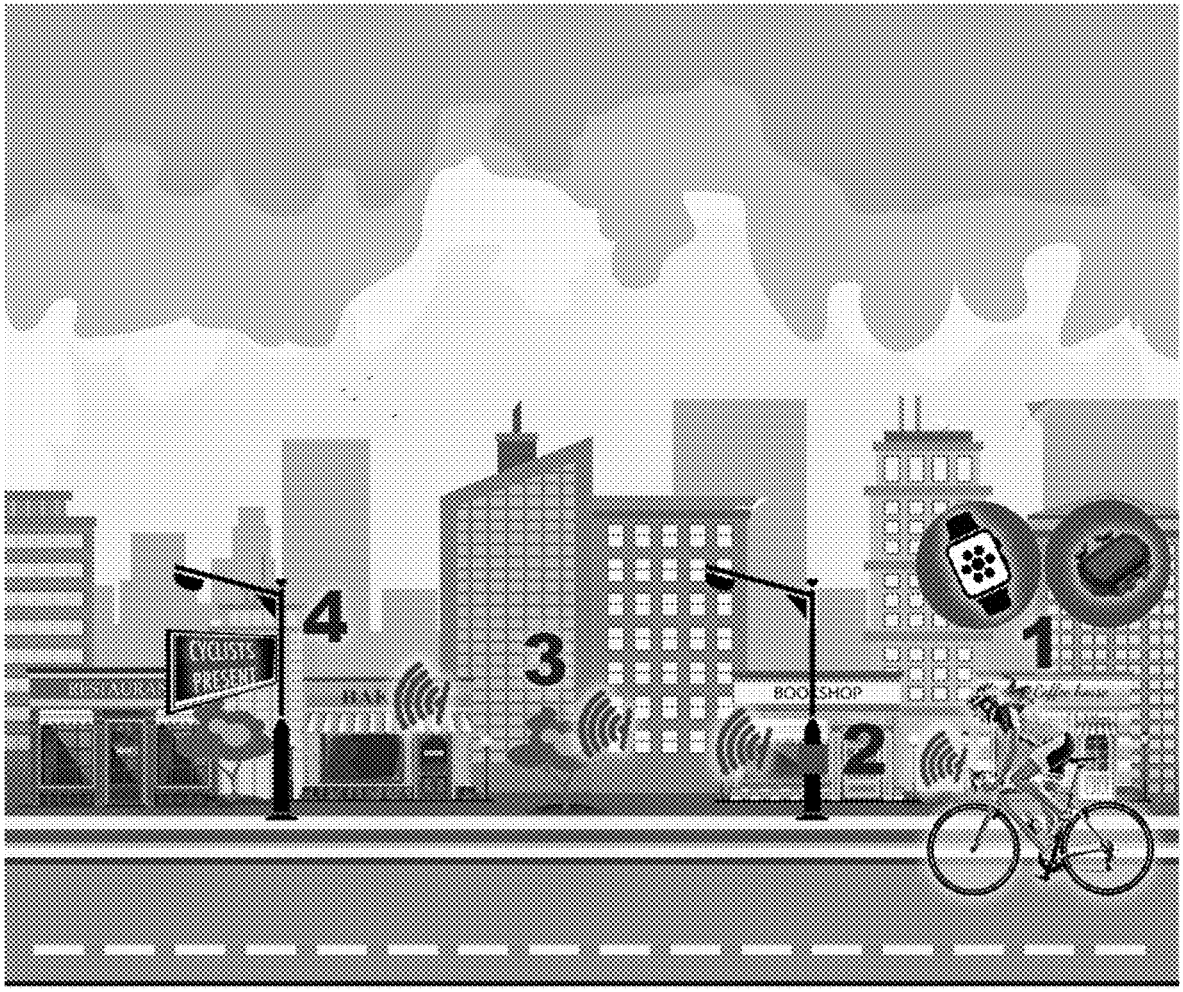
FIG. 1 illustrates a perspective view of the Bicycle Safety Street Warning ("BSSW") system, according to embodiments herein.

At the present time, there are a few radar bicycle detectors, but these are installed under the pavement and only activated when the bicycles circulate in specifically designed bicycle paths. Because most transportation departments have adopted laws that grant bicycles the right to use entire lanes as if they were vehicles, the BSSW operates under such conditions because the trigger mechanism that sends the signal to the box is automatically activated when the bicycle approaches the box and the box is able to pick up the signal to relay it to the screen (See FIG. 1).

The first step includes the transmission of the signal while in movement. This is achieved automatically by the battery (CR2032) powered sensor/transmitter (See FIG. 1, item 1). This sensor is approximately equal in size to a common cadence or speed sensor on any bicycle (approximately 1.5"×1"). The sensor can also be incorporated into a bicycling computer wristwatch for comfort.

Figure 2:
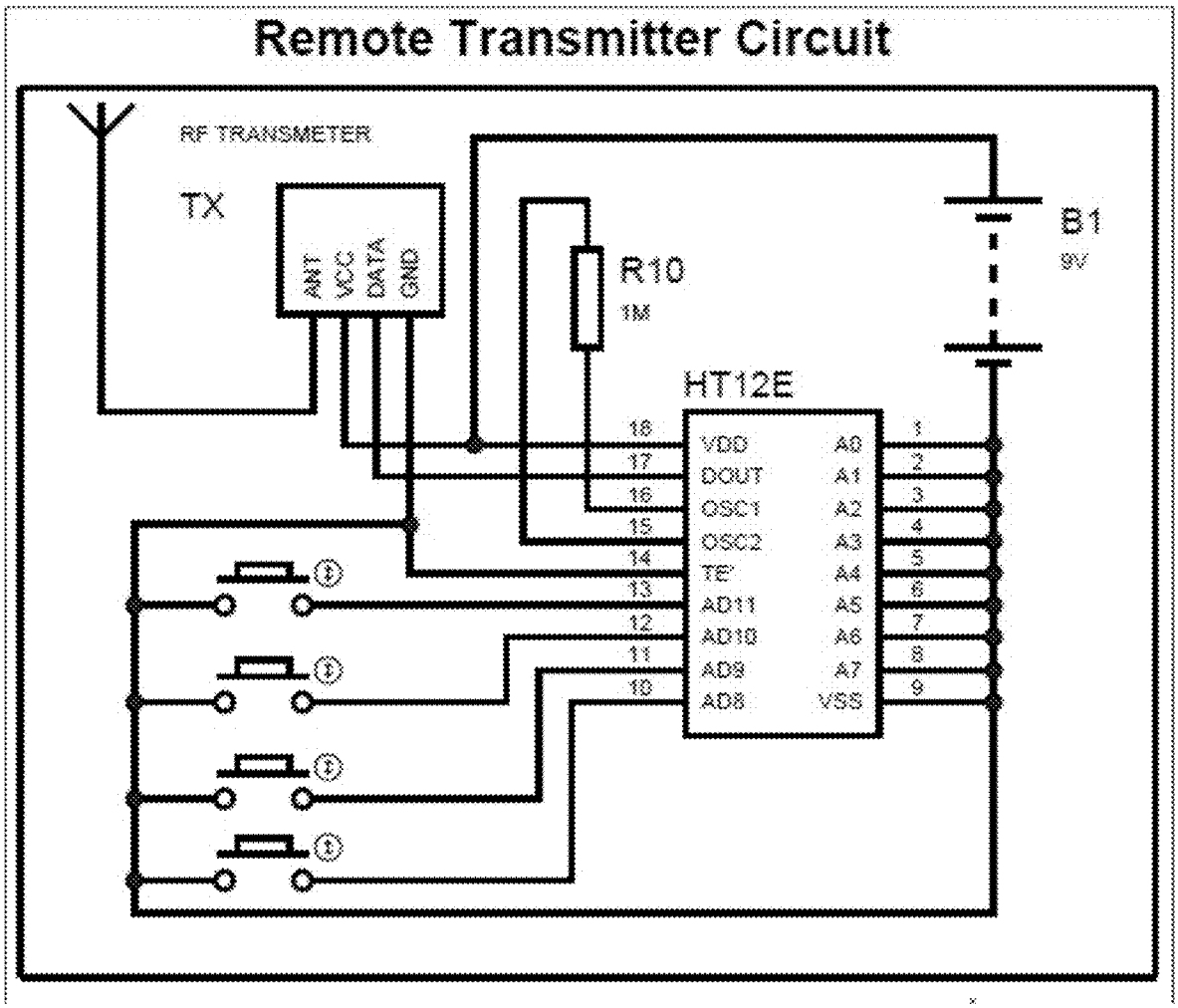
FIG. 2 illustrates a circuit diagram of at least a transmission portion of a transceiver configured to be mounted with an existing or new street pole.

The second step includes the actual transmission of the signal from the sensor to the box (See FIG. 1, item 2) which contains the receiver. The receiver is merely a 6"×4" device which is hidden inside the box for security, with an exposed antenna for enhanced reception. When the signal is received by the box, it is magnified and transmitted to the pole where the screen is mounted. (See FIG. 2). In other words, the receiver may be implemented as a transceiver configured to transmit the received signal with increased signal strength to such pole.

The third step includes a box disposed behind the screen, i.e., a screen receiver box, receiving the magnified signal and executing an electronic command which will prompt the screen to forecast the message "Cyclists Present." Both such receiver box and the screen will be connected to an ordinary power source.

The system will be capable of being programmed to reflect and report the actual number of cyclists in the area and even the direction or path that they are following. This would allow motorists to form a mental image of the volume of cyclists and react accordingly. The aforementioned box could easily be attached to a local (City, County, Municipality, or even Federal Transportation Authorities) monitoring system so as to evaluate progress, improvement, and statistics.

Research

The research related to this invention consisted of examining and evaluating numerous studies and statistics related to traffic safety. In the process, we met with numerous county authorities and corroborated the usefulness and demand for such a system capable of alerting motorists that a bicyclist was present. The majority of the evaluation was conducted in the Miami-Dade County area, which is the third most populated area in the country for cyclists. As such, we met with twenty of the most prominent cycling clubs in the area, as well as county authorities in charge of programs such as "Share the Road," and discussed the permeating issues surrounding the relationship-or lack thereof-between motorists and cyclist.

All studies and evaluations concluded that the majority of cyclists tend to deviate from the bicycle paths constantly. In fact, since the passage of the law allowing bicycles to use the "entire lane," cyclists have grown more bold and even aggressive, thereby creating an even greater hazard for all: pedestrians, motorists and cyclists themselves. Other systems in place only affect bicycle paths, which represent the "road less traveled" by cyclists. Groups in and around Miami-Dade tend to be far more aggressive and usually travel in larger groups (greater than 40 riders), thereby occupying entire lanes. However, their aggressive style also encourages them to "sprint" (erupt into faster pace for shorter distances) which in turn forces many of them to spill over onto other lanes. This has resulted in serious injuries and death over the past decade.

The invention claimed is:

1. A remote safety triggering system causing information to be exhibited on a display, the system comprising:

a) one or more remote triggering sensors respectively attached to (i) one or more bicycles being operated by one or more cyclists or (ii) the one or more cyclists, each of the one or more remote triggering sensors transmits a first signal comprising a first signal strength;

b) a transceiver, positioned by a sidewalk, receiving the first signal, and in response transmitting a second signal comprising a second signal strength of greater magnitude than the first signal strength; and c) a receiver operatively coupled with the display to receive the second signal, whereby in response to receipt of the second signal the display exhibits the information thereon, wherein the first signal is automatically received at the transceiver in response to the one or more cyclists when present within a predetermined distance from the transceiver, the receiver is disposed adjacent to the display and remote from the transceiver, and based on receipt of the first signal by the transceiver positioned within the predetermined distance, the information comprises a statement defining a number and a direction of travel of the one or more cyclists while disposed within the predetermined distance.

2. The system of claim 1, wherein:

the receiver is disposed at a predetermined, fixed distance from the transceiver.

* * * * *